US006443417B2

(12) United States Patent
Galant

(10) Patent No.: US 6,443,417 B2
(45) Date of Patent: Sep. 3, 2002

(54) ANTI-THEFT DEVICE FOR LAP TOP COMPUTER

(76) Inventor: Steve N. Galant, 86 Paula Court, P.O. Box B1, Kleinburg, Ontario (CA), L0J 1C0

( * ) Notice: Subject to any disclaimer, the term of this patent is extended or adjusted under 35 U.S.C. 154(b) by 0 days.

(21) Appl. No.: 09/801,232

(22) Filed: Mar. 7, 2001

Related U.S. Application Data

(63) Continuation-in-part of application No. 09/563,184, filed on May 2, 2000, now Pat. No. 6,308,928.

(51) Int. Cl.[7] ..... E05B 73/00
(52) U.S. Cl. ..... 248/553; 70/19; 70/58
(58) Field of Search ..... 248/551, 552, 248/553; 70/18, 19, 58, 164, 209

(56) References Cited

U.S. PATENT DOCUMENTS

| | | | | |
|---|---|---|---|---|
| 3,744,282 A | | 7/1973 | Hemphill | 70/58 |
| 4,028,913 A | * | 6/1977 | Falk | 248/553 |
| 4,170,334 A | | 10/1979 | Villanueva | 248/553 |
| 4,585,202 A | * | 4/1986 | Parsekian | 248/500 |
| 5,052,199 A | * | 10/1991 | Derman | 70/19 |
| 5,277,042 A | | 1/1994 | Tobias | 70/209 |
| 5,351,508 A | * | 10/1994 | Kelley | 16/445 |
| 5,582,044 A | * | 12/1996 | Bolich | 224/315 |
| 5,595,074 A | * | 1/1997 | Munro | 248/551 |
| 5,642,634 A | * | 7/1997 | Perry | 248/552 |
| 5,836,183 A | * | 11/1998 | Derman | 248/553 |
| 6,216,499 B1 | | 4/2001 | Ronberg et al. | 70/58 |

FOREIGN PATENT DOCUMENTS

| | | |
|---|---|---|
| CA | 2246139 | 2/2000 |
| CA | 2281466 | 2/2000 |

* cited by examiner

*Primary Examiner*—Leslie A. Braun
*Assistant Examiner*—Jon Szumny
(74) *Attorney, Agent, or Firm*—Ridout & Maybee LLP

(57) ABSTRACT

An anti-theft device for securing a lap top computer to a support member, the device having a rigid securing member. The rigid securing member has a back, side and front restraining members defining an elongate opening dimensioned to slidably receive a monitor of the lap top computer therethrough when the computer is in the open position. The device further includes a locking assembly having a first part rigidly coupled to the securing member and a second part which can be anchored to the support member, the first and second parts being movable together into a securing position to clamp the lap top computer to the support member, and apart into a release position to allow the lap top computer to be removed. A second securing member is provided to secure the lap top in the closed position.

20 Claims, 8 Drawing Sheets

ANTI-THEFT DEVICE FOR LAP TOP COMPUTER

This application is a continuation-in-part of U.S. patent application Ser. No. 09/563,184 filed May 2, 2000 now U.S. Pat. No. 6,308,928 for Anti-Theft Device for Lap Top Computer.

BACKGROUND OF THE INVENTION

The present invention relates to an anti-theft device for securing a lap top computer to a support member such as a desk top.

A variety of techniques and apparatus have been developed over the years to prevent the unauthorized removal of computer equipment. A number of anti-theft devices have been developed specifically for tower style and desk top computers, as depicted in U.S. Pat. No. 5,085,395 issued Feb. 4, 1992 to Fater et al, and U.S. Pat. No. 4,585,202 issued Apr. 29, 1986 to Parsekin. Such devices are not designed to be used with clam shell style lap top computers which are most often the targets of computer theft.

Anti-theft devices which use flexible cables to secure either lap top computers or tower and desk top style computers are also known. However, such devices offer limited security as the cables can often be cut relatively easily.

There is a need for an anti-theft device that can be used to secure a lap top computer to a work surface or support member, and which provides an increased level of security over traditional cable devices.

It is also desirable to provide a lap top computer anti-theft device which allows for the easy authorized removal of a lap top computer and is cost-effective to manufacture. It is also desirable to provide an anti-theft device that can be used to secure a lap top computer in both the open and closed positions.

SUMMARY OF THE INVENTION

Accordingly, the present invention provides an anti-theft device for securing a lap top computer to a support member, the lap top computer having a first portion and a second portion pivotally connected together for movement between an open position in which the first portion extends at an angle from the second portion, and a closed position in which the first portion and second portion are substantially parallel to and adjacent to each other. The device includes a rigid securing member having back, side and front restraining members defining an elongate opening dimensioned to slidably receive the first portion therethrough. The device further includes a locking assembly having a first part rigidly coupled to the securing member and a second part adapted to be anchored to the support member, the first and second parts being movable together into a securing position, and apart into a release position. When a lap top computer is positioned on the support member in an open position with the first portion extending through the elongate opening and the locking assembly is moved to the securing position, the second portion is confined between the securing member and the support member and the first portion is confined within the elongate opening to prevent removal of the lap top from the support member. When the locking assembly is moved to the release position, the securing member is moved away from the support member a distance which allows the lap top computer to be removed from the support member.

The anti-theft device may include a further rigid securing member adapted to interlock with and be positioned generally transversely to said rigid securing member to secure a lap top in the closed position to a support member.

BRIEF DESCRIPTION OF THE DRAWINGS

For a better understanding of the invention, and to show how it may be carried into effect, reference will now be made, by way of example, to the accompanying drawings, in which.

DESCRIPTION OF THE PREFERRED EMBODIMENTS

Figure 1:
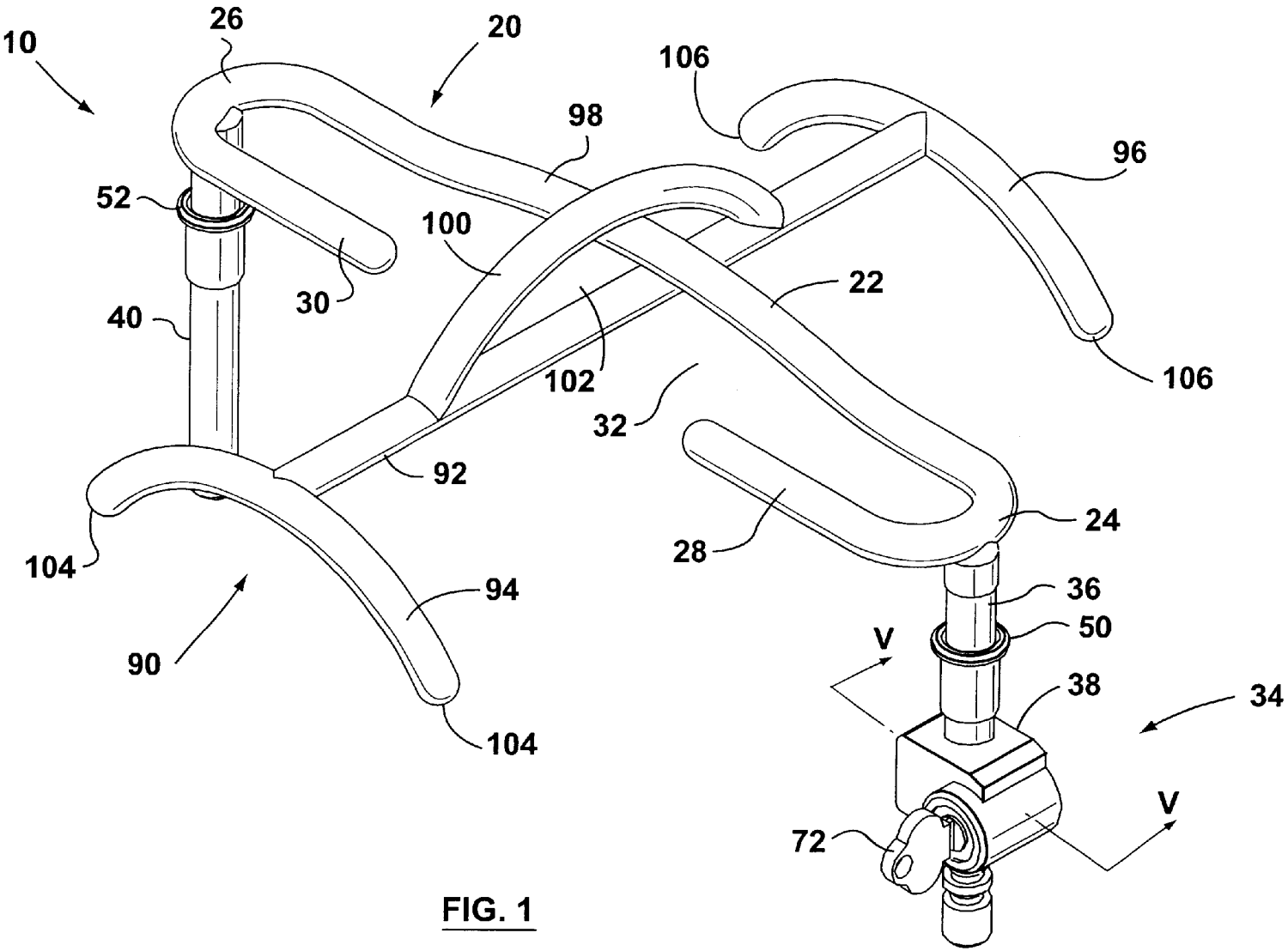
FIG. 1 is an isometric view of an anti-theft device in accordance with a first preferred embodiment of the invention.
Figure 2:
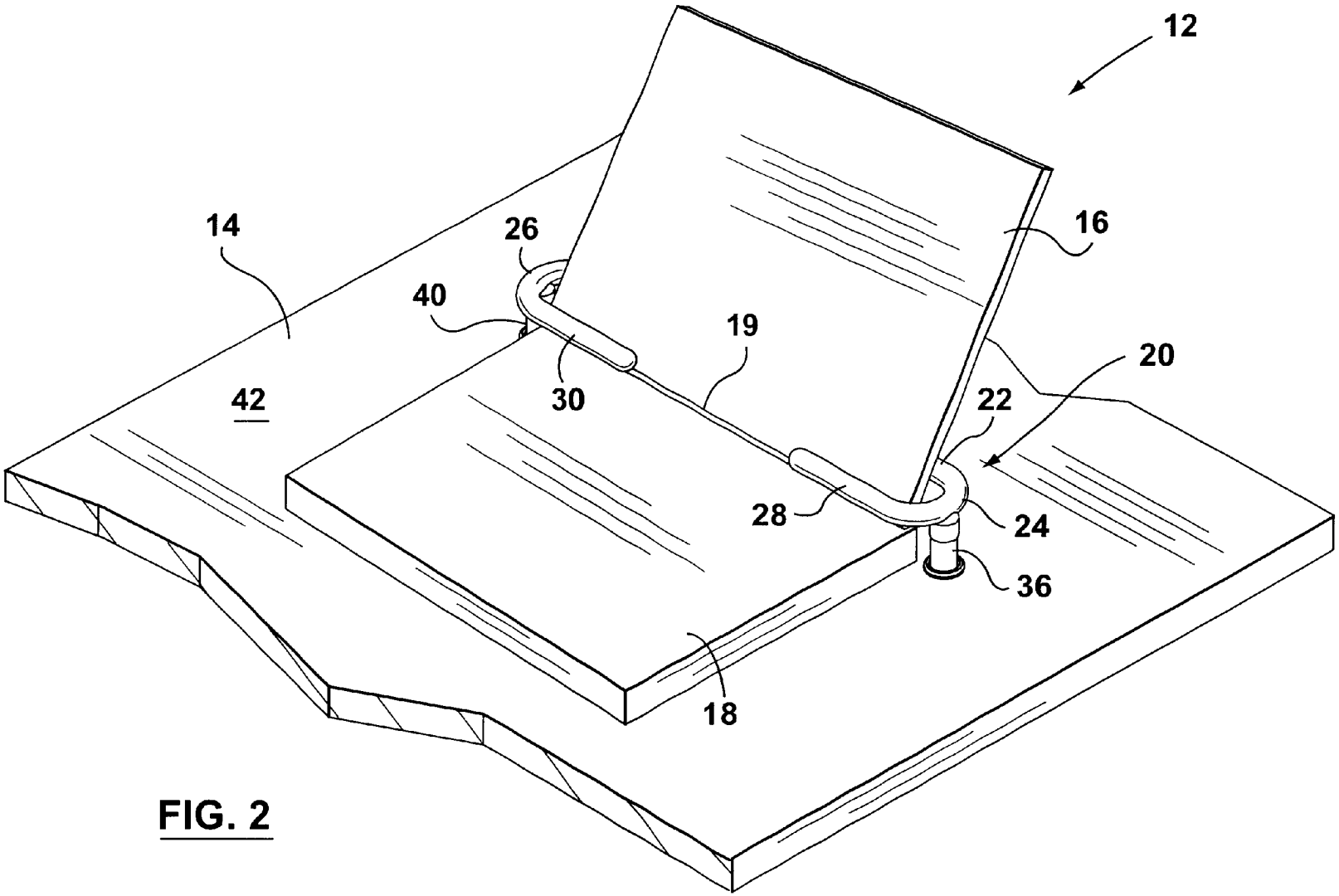
FIG. 2 is an isometric view of the anti-theft device of FIG. 1 shown in use securing a lap top computer in the open position to a desk top.
Figure 3:
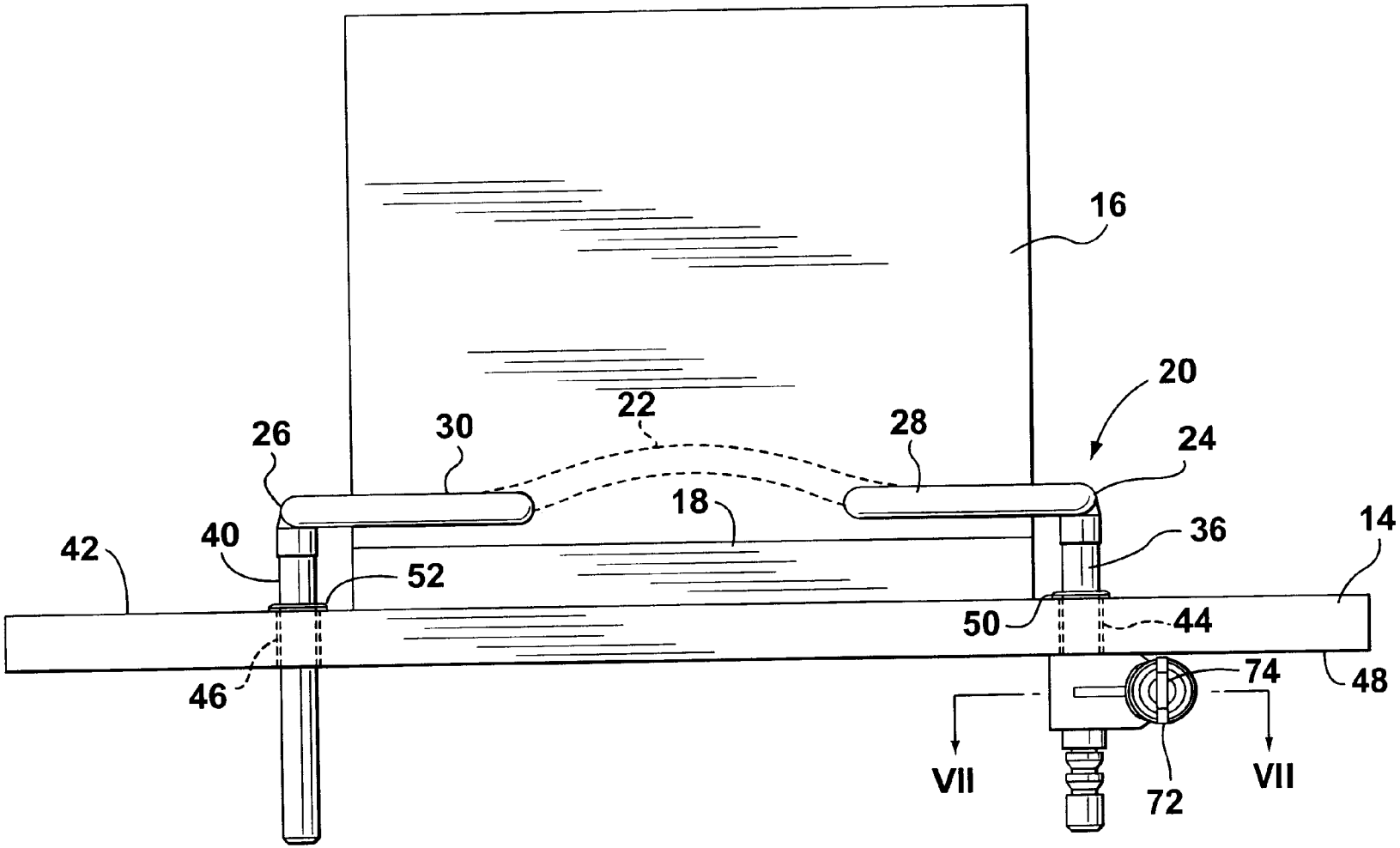
FIG. 3 is a front view of the anti-theft device of FIG. 1 shown in use securing the open lap top computer to the desk top.

Referring to FIGS. 1 and 2, an anti-theft device, indicated generally by reference numeral number 10, for securing a lap top computer 12 to a support member such as a desk top 14, is shown. The lap top 12 has a first portion in the form of a monitor portion 16 and a second portion in the form of a keyboard portion 18 pivotally connected to the monitor portion 16 for movement about a hinge 19 between an open position (shown in FIGS. 2 and 3) in which the monitor portion 16 extends at an angle from the keyboard portion 18, and a closed position (shown in FIG. 4) in which the monitor portion 16 and keyboard portion 18 are substantially parallel to and adjacent to each other.

The device 10 includes a rigid securing member designated generally by reference numeral 20 made of hardened tubular steel provided with a vinyl coating. The securing member 20 has an elongate back restraining member 22 and a pair of U-shaped side restraining members 24, 26 extending from respective opposite ends of the back restraining member 22. The securing member 20 also has a pair of front restraining members 28, 30 extending inwardly from the front ends of the respective side restraining members 24,26 in generally parallel relationship to the back restraining member 22. The securing member 20 is dimensioned to define an elongate opening 32 (FIG. 1) which can slidably receive the monitor portion 16 therethrough.

The device 10 also includes a locking assembly indicated generally by numeral 34 in FIG. 1 having a first part in the form of a first leg 36 made of a hardened tubular steel rod rigidly attached to and extending downwardly from the side restraining member 24 of the securing member 20. The locking assembly also has a second part in the form of a locking device 38 which is telescopically engageable with and securable to the first leg 36 at a selected one of a plurality of locations along the length of the leg 36, as will be described in more detail below.

In this embodiment, the anti-theft device 10 also has a second leg 40 rigidly attached to and extending downwardly from the other side restraining member 26. The second leg 40 has a smooth outer exterior, and extends parallel to and is spaced from the first leg 36 a distance such that the legs 36, 40 can straddle the width of the lap top computer 12. As can best be seen with reference to FIG. 3, to use the device 10, the lap top 12 is placed on an upper surface 42 of the desk top 14 between a pair of spaced apart predetermined holes 44, 46 extending through the desk top 14 from the upper surface 42 through to a lower surface 48 thereof. The holes 44, 46 are reinforced by plastic tubular plugs 50, 52 which have been inserted into the holes 44, 46 and which also facilitate the insertion and removal of the device 10 in and from the holes 44, 46. The securing member 20 is then slid over the monitor portion 16 so that the monitor portion 16 is received within the elongate opening 32. At the same time, the first and second legs 36, 40 are inserted in the tubular plugs 50, 52, respectively, and moved downwardly to extend partly below the desk top 14 until the securing member 20 engages the top of the keyboard portion 18. The first leg 36 and the locking device 38 are moveable together into a securing position by telescoping the locking device 38 upwardly and locking it to the first leg 36 below the desk top 14 to clamp the keyboard portion 18 and desk top 14 together between the securing member 20 and locking device 38. When so clamped, the monitor portion 16 is confined within the elongate opening 32. Thus, forward and upward motion of the lap top 12 are restricted by the front restraining members 28, 30. The back restraining member 22 restrains rearward motion. Sideways motion is similarly restricted by the side restraining members 24, 26. Removal of the lap top 12 is thus prevented. Clearly, for the device 10 to work, the locking device 38 must be dimensioned to be larger than the hole 44 with the tubular plug 50 mounted therein so that an attempt to remove the securing member 20 from the desktop 14 would be prevented by the locking device 38 engaging the lower surface 48 of the desk top 14, thereby restricting further upward motion of the securing member 20. It will be appreciated that when the locking device 38 is secured to the first leg 36, the locking device 38 is effectively anchored to the desk top 14, thereby anchoring other portions of the device 10 to which the locking device 38 is secured.

When it is desired to remove or transport the lap top 12, the locking device 38 is disengaged from the first leg 36 and the securing member 20 is moved to a release position by lifting it upwardly and away from the desk top 14 a distance which would allow the lap top computer 12 to be removed. Of course, the securing member 20 may be removed completely and set aside when not in use.

Figure 5:
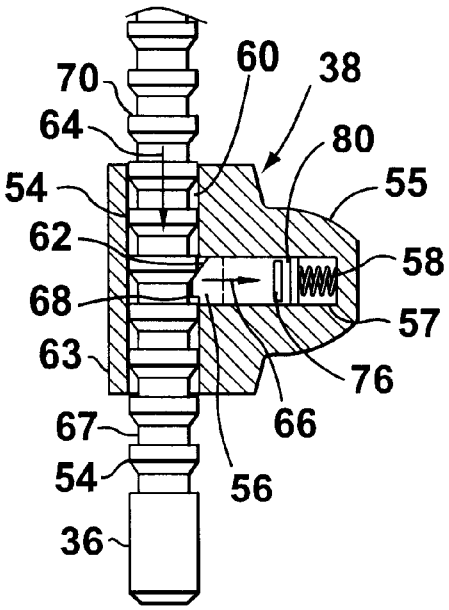
FIG. 5 is an enlarged partial cross-sectional view taken generally along line V—V of FIG. 1 showing a locking assembly of the device being actuated to bring the locking assembly into a securing position.
Figure 6:
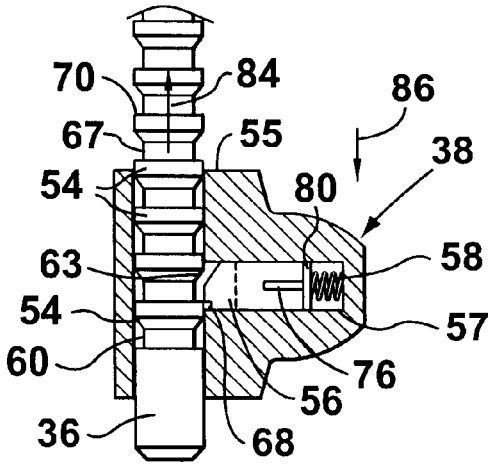
FIG. 6 is a view similar to the view of FIG. 5, showing the locking assembly being moved to a release position.
Figure 7:
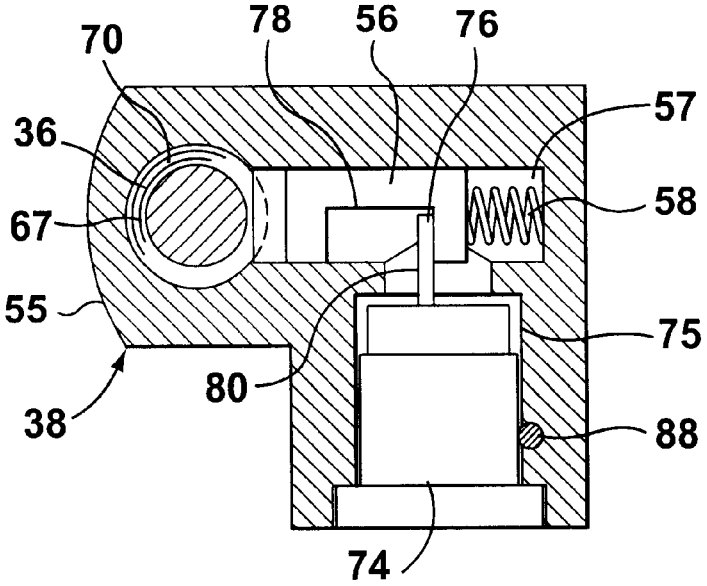
FIG. 7 is an enlarged cross-sectional view of the locking assembly taken along line VII—VII of FIG. 3.

The locking assembly 34 will now be described in detail with reference to FIGS. 5 to 7. As seen in FIGS. 5 and 6, the first leg 36 includes a plurality of ratchet teeth 54 spaced along the length thereof. The locking device 38 has a hardened steel lock housing 55 having a blind hole 57 in which is situated a spring-loaded pawl 56. The spring-loaded pawl 56 is normally biased into a locked position (shown in FIGS. 5 and 7) under the influence of a spring 58. In this position, the spring 58 biases the pawl 56 part way into a passageway 60 of the locking device 38 for receiving the first leg 36 therethrough. The pawl 56 presents an inclined surface 62 (labelled only in FIG. 5) for meeting a frusto-conical surface 63 of the ratchet teeth 54. Such allows the first leg 36 to be advanced within the passageway 60 relative to the locking device 38 in the direction of arrow 64 shown in FIG. 5. When moved in this direction the pawl 56 is pushed into the blind hole 57, by each ratchet tooth 54 passing the pawl 56. As each ratchet tooth 54 passes the pawl 56, the spring 58 urges the pawl 56 back into an annular space 67 between adjacent ratchet teeth 54. When the pawl 56 is positioned in the annular space 67, movement of the first leg 36 in a direction opposite to the direction shown by arrow 64, relative to the locking device 38, is blocked by the engagement of a transversely-extending planar lower surface 68 of the pawl 56 with a portion of a planar annular surface 70 of a subject ratchet tooth 54 (as shown in FIG. 6). Thus, the spring-loaded pawl 56 permits the locking device 38 to be telescoped onto the first leg 36 while preventing the locking device 38 from being removed therefrom when the locking device 38 is in the locked position.

To unlock the device 38, a key 72 (shown in FIGS. 1 and 3) is inserted into a key hole in a key lock cylinder 74 which is seated and retained in a key lock cylinder hole 75 by a locking pin 88. The key lock cylinder hole 75 extends at a right angle to the blind hole 57. The key lock cylinder 74 has a torque blade 76 which extends into a groove 78 formed in the pawl 56 to bear against a torque blade surface 80 of the pawl 56. Rotating the key 72 clockwise, causes the torque blade 76 to rotate and displace pawl 56 into the blind hole 57, to compress the spring 58, and away from the passageway 60 (as shown in FIG. 6). In this position, the locking device 38 is unlocked and the first leg 36 may be removed from the steel lock housing 55 as shown by arrows 84, 86 in FIG. 6. Releasing the key 72 causes the pawl 56 to enter the passageway 60 under the influence of the spring 58.

Figure 4:
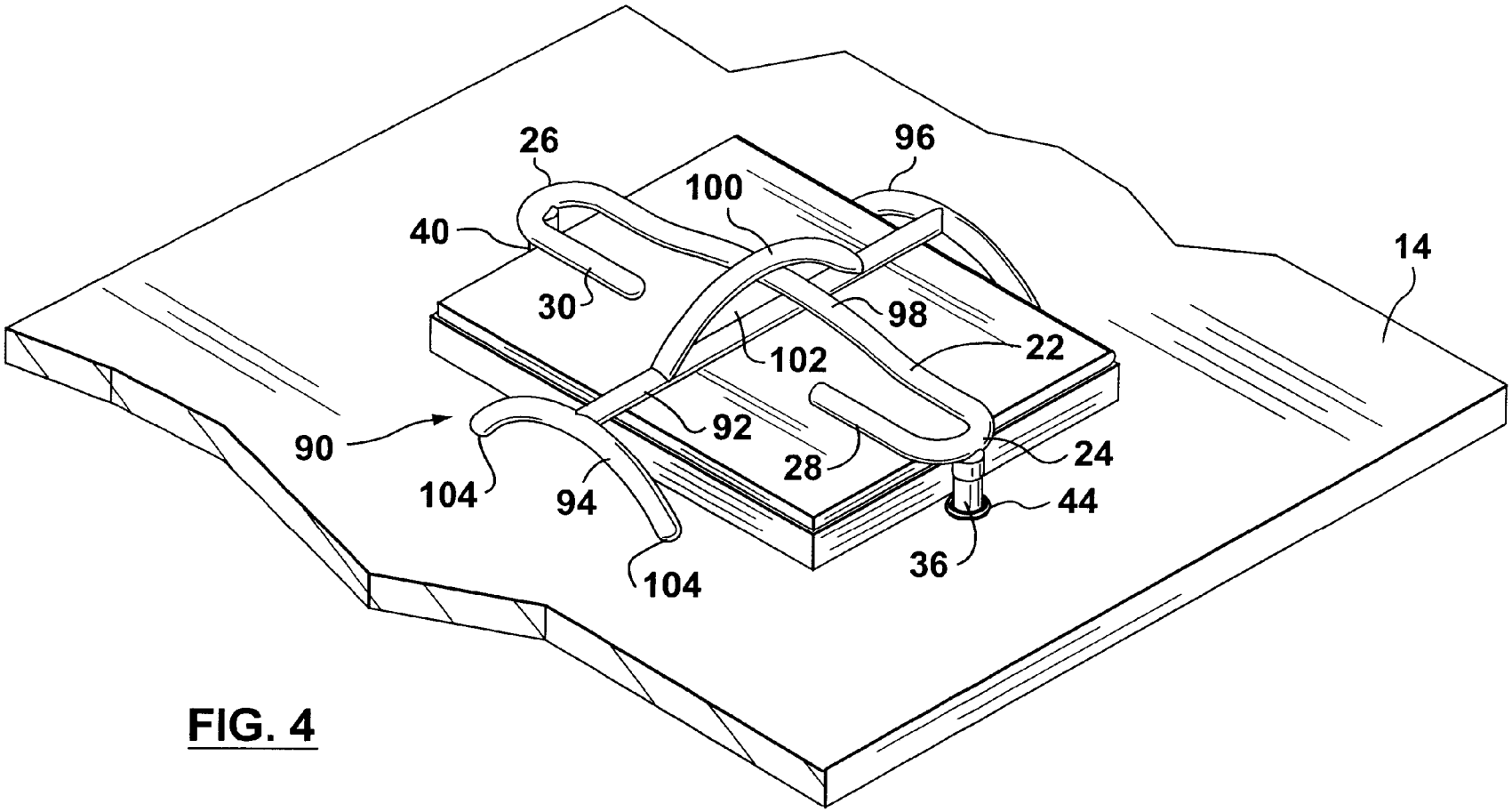
FIG. 4 is an isometric view showing the anti-theft device of FIG. 1 in use securing the lap top computer in the closed position to the desk top.

Referring now to FIGS. 1 and 4, it will be seen that the device 10 has a second rigid securing member 90 for use in securing the lap top computer 12 in a closed position. The second securing member 90 includes an elongate intermediate member or bar 92 with first and second stop members 94, 96 located at opposite ends thereof. In the embodiment shown, the first and second stop members 94, 96 are each downwardly arcuate bars. The second securing member 90 and first securing member 20 are each configured such that they interlock with each other. In particular, in the illustrated embodiment, the back restraining member 22 has a raised central portion 98 under which the intermediate bar 92 can pass. An arcuate member 100 is provided on the upper side of the intermediate bar 92 and together they define an opening 102 through which the back restraining member 22 passes.

With reference to FIG. 4, the closed lap top 12 is positioned between the holes 44, 46 such that it can be straddled by the first and second legs 36 and 40 when the legs are inserted through the holes 44, 46. Prior to mounting the first securing member 20 to the desk top 14, the first and second securing members 20 and 90 are interlocked by threading one of the legs 36, 40 through the opening 102 of the second securing member 90 until the intermediate bar 92 is located under the raised central portion 98 of the back restraining member 22. The first and second securing members 20, 90 are then secured to the desk top 14 over the lap top computer 12 as illustrated by inserting the first and second legs 36, 40 through the holes 44, 46 in the desk top 14 until the securing members 20, 90 contact an upper surface of the lap top computer 12. The locking device 38 is then secured to the first leg 36 as discussed above.

The raised central portion 98 of the back restraining member 22 provides clearance for the intermediate bar 92 to pass underneath the back restraining member 22. The first and second arcuate stop members 94 and 96 each preferably include a pair of feet 104, 106 which rest on the desk top 14.

Once the first and second securing members 20, 90 are secured to the desk top 14 over the closed lap top computer 12, the first and second legs 36, 40 restrain sideways movement of the computer 12, and the first and second stop members 94, 96 restrain forward and backward movement. Upward movement is restrained by the intermediate bar 92, and the back and front restraining members 22, 28 and 30.

The sizing of the first and second securing members 20 and 90 is preferably such that the anti-theft device 10 can be used with different lap top computers falling within a predetermined range of conventional sizes.

Figure 8:
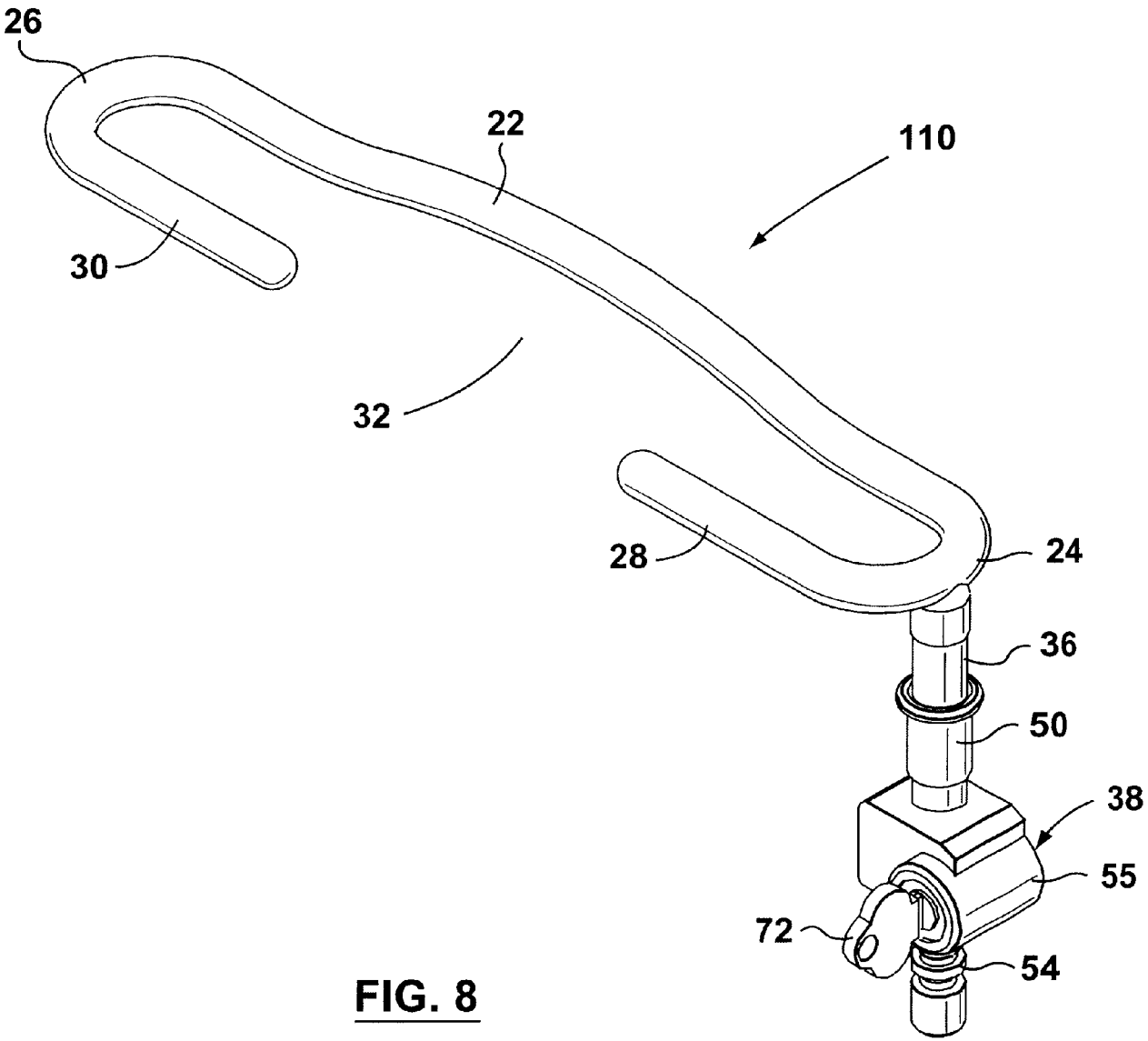
FIG. 8 is an isometric view of a second preferred embodiment of an anti-theft device in accordance with the present invention.

With reference to FIG. 8, a further possible embodiment of an anti-theft device, indicated generally by reference numeral 110, is illustrated. The antitheft device 110, which is suitable for securing a lap top computer in the open position only, is identical in construction and operation to the anti-theft device 10 described above, and similar reference numerals have been used to denote similar parts. The device 110 differs from the device 10 only in that the device 110 includes a single leg 36 for insertion through the desk top 14 and does not include a second securing member 90.

Figure 9:
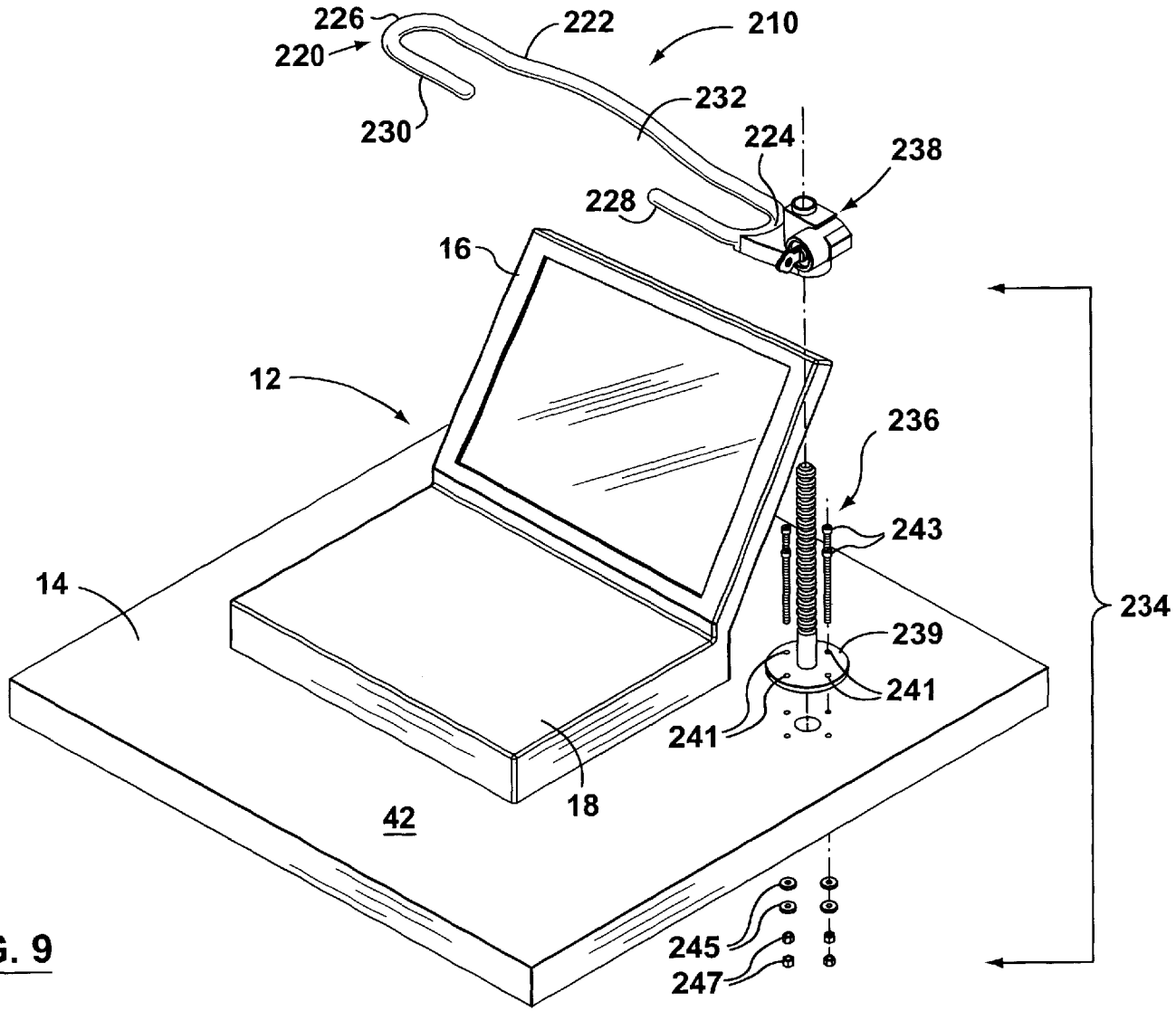
FIG. 9 is an isometric exploded view of an anti-theft device according to a third preferred embodiment of the invention for use in securing an open lap top to a desk top.
Figure 10:
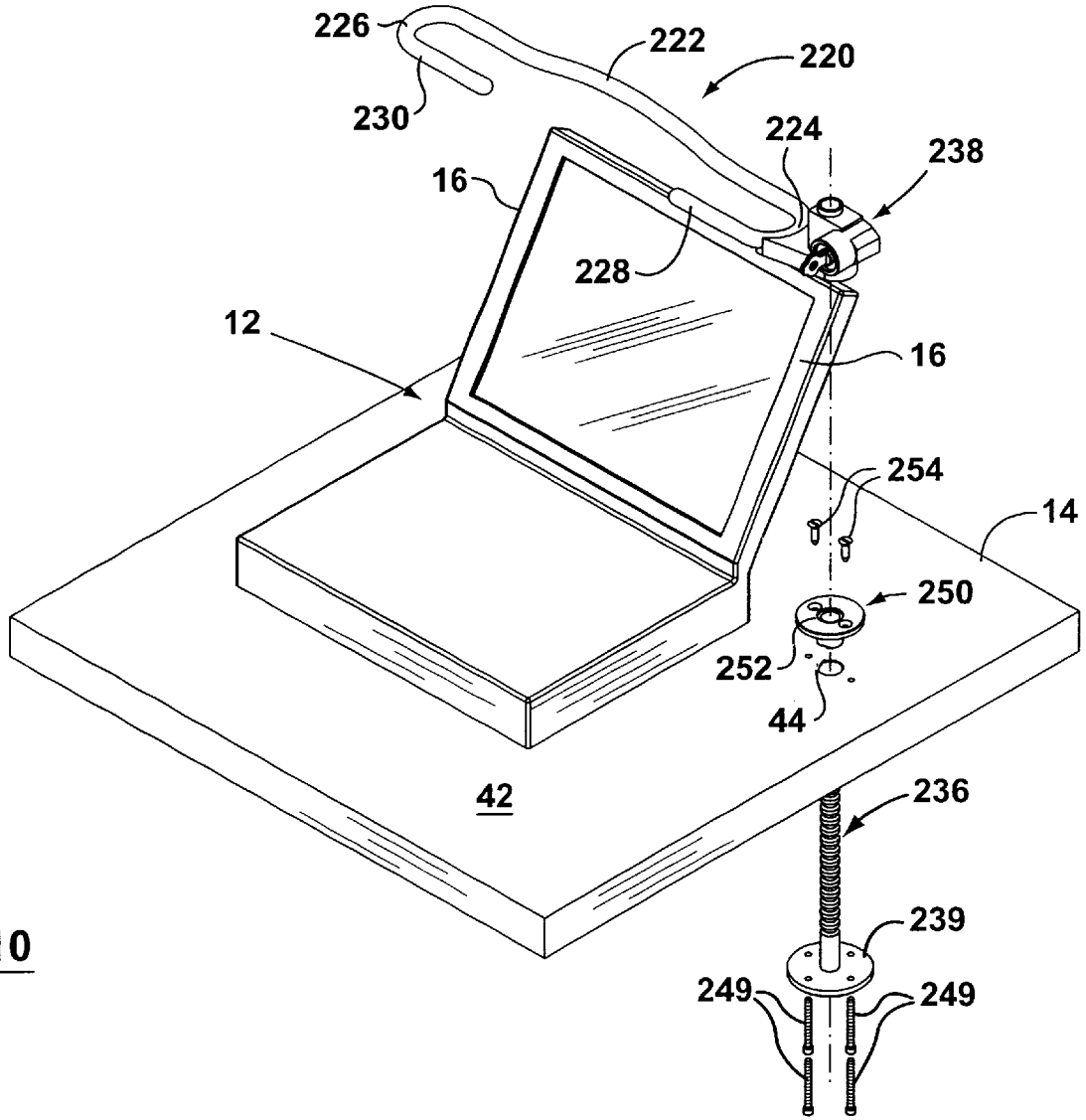
FIG. 10 is a view similar to the view of FIG. 9 showing an alternative method of securing a locking leg of the anti-theft device of FIG. 9 to the desk top.

FIGS. 9 and 10 illustrate an anti-theft device 210 according to a third preferred embodiment of the invention. This embodiment 210 is to be preferred in situations where access to a locking assembly 234 above the desk top 14 is desired. Similar to the anti-theft device 110 described above, the anti-theft device 210 is for securing a lap top computer 12 in the open position and includes a rigid securing member 220 made of hardened tubular steel provided with a vinyl coating. The securing member 220 has an elongate back restraining member 222 and a pair of U-shaped side restraining members 224, 226 extending from respective opposite ends of the back restraining member 222. The securing member 220 also has a pair of front restraining members 228, 230 extending inwardly from the front ends of the respective side restraining members 224, 226 in generally parallel relationship to the back restraining member 222. The securing member 220 is dimensioned to define an elongate opening 232 which can slideably receive the monitor portion 16 of the lap top 12 therethrough.

The device 210 also includes a locking assembly 234 having first and second parts. The second part is in the form of a leg 236 made of a hardened tubular steel rod rigidly attached to and extending upwardly from an anchor member in the form of a circular base plate 239 provided with a plurality of holes 241 for use in securing the base plate and hence leg 236 to the desk top 14 using bolts, washers and nuts 243, 245, 247. The first part is in the form of a locking device 238 rigidly attached to the side restraining member 224. The locking device 238 is similar in construction and operation to the locking device 38 and will thus not be described further except to point out that the locking device 238 is configured to receive the leg 236 from below rather than from above, as in the case of the locking device 38. Suitable modifications to the locking device 238 to ensure its operation in this manner will become apparent to the person skilled in the art. Thus, the locking device 238 is telescopically engageable with and securable to the leg 236 at a selected one of a plurality of locations along the length of the leg 236 in a similar manner as described above with respect to the first and second preferred embodiments.

The anti-theft device 210 can be used in one of two ways. Referring to FIG. 9, the first way is to bolt the base plate 239 to the upper surface 42 of the desk top 14 with the leg 236 extending upwardly in a normal direction from the base plate 239. The lap top 12 can then be positioned adjacent to the leg 236 in the open position and the securing member 220 slid down over the monitor portion 16 with the monitor portion 16 received within the elongate opening 232. At the same time, the locking device 238 is telescoped downwardly and locked to the leg 236 to clamp the keyboard portion 18 to the desk top 14. When so clamped, the monitor portion 16 is confined within the elongate opening 232. Thus, forward and upward motion of the lap top 12 are restricted by the front restraining members 238, 230. The back restraining member 222 restrains rearward motion. Sideways motion is similarly restricted by the side restraining members 224, 226. Removal of the lap top 12 is thus prevented.

Referring to FIG. 10, the anti-theft device 210 may be used in a second way to secure the lap top 12 to a desk top 14 having a predetermined hole 44 extending between upper and lower surfaces thereof. The leg 236 may be inserted through the hole 44 from below the desk top 14 so as to extend partly above the desk top 14, and held in position using bolts 249 which affix the circular base plate 239 to a lower surface of the desk top 14. The locking device 238 may then be telescoped onto and locked to the leg 236 from above the desk top 14, thereby clamping the keyboard portion 18 and desk top 14 between the securing member 220 and the base plate 239. As in the case of the first and second preferred embodiments, a hollow tubular plastic plug 250 is seated in the hole 44 to facilitate insertion and removal of the leg 236 as well as to reinforce the hole 44 against damage. In this case, however, the plug 250 has a widened annular flange 252 apertured to permit the flange 252 to be secured to the upper surface 42 of the desk top 14 using screws 254.

It will be appreciated that the front restraining members 28, 30 or 228, 230 in the illustrated embodiments could be replaced with a single piece extending between the two side restraining members 24, 26 or 224, 226. However, the use of two separate front restraining members offers a benefit in that it minimizes visual interference with the monitor portion 16. It will also be appreciated that the anti-theft devices 10, 110 and 210 need not include front restraining members at all if they are only used to secure the lap top computer in the closed position.

It will be appreciated that a different locking means could be used to secure the first leg 36, 236 other than that described above. For example, a series of spaced holes could be provided along the length of first leg 36, 236 and used in conjunction with a padlock to secure the lap top computer to the desktop.

As will be apparent to those skilled in the art in the light of the foregoing disclosure, many alterations and modifications are possible in the practice of this invention without departing from the spirit or scope thereof. The foregoing description is of the preferred embodiments and is by way of example only, and is not to limit the scope of the invention.

I claim:

1. An anti-theft device for securing a lap top computer to a support member, the lap top computer having a first portion at second portion pivotally connected together for movement between an open position in which the first portion extends at an angle from the second portion, and a closed position in which the first portion and second portion are substantially parallel to and adjacent to each other, the device comprising a rigid securing member having back, side and front restraining members defining an elongate opening dimensioned to slidably receive the first portion therethrough; and a locking assembly having a first part rigidly coupled to said securing member and a second part adapted to be anchored to the support member, said first and second parts being movable together into a securing position, and apart into a release position;

wherein, when a lap top computer is positioned on the support member in an open position with the first portion extending through the elongate opening and the locking assembly is moved to the securing position, the second portion is confined between the securing member and the support member and the first portion is confined within said elongate opening to prevent removal of the lap top from said support member, and when the locking assembly is moved to the release position, the securing member is spaced from the support member a distance which allows the lap top computer to be removed from the support member.

2. The anti-theft device according to claim 1 wherein one of said first and second parts comprises a leg, and the other of said first and second parts comprises a locking device telescopically engageable with and securable to said leg at a selected one of a plurality of locations along the length of said leg.

3. The anti-theft device according to claim 2 wherein said leg comprises a plurality of ratchet teeth spaced along the length thereof, and said locking device has a pawl movable between a locked position in which the pawl engages a selected one of said ratchet teeth thereby preventing separation of said securing member and said second part, and an unlocked position in which said pawl is disengaged from said teeth such that said securing member and said second part may be slid apart.

4. The anti-theft device according to claim 3 wherein the locking device includes a key lock which actuates the pawl to engage and disengage the ratchet teeth.

5. The anti-theft device according to claim 3 wherein the pawl is spring loaded to permit the locking device to be telescoped onto said leg while preventing it to be removed therefrom when the locking device is in said locked position.

6. The anti-theft device according to claim 2 wherein said securing member includes a pair of said side restraining members, each side restraining member extending from a respective opposite end of said back restraining member, and a pair of said front restraining members, each extending from a respective one of said side restraining members.

7. The anti-theft device according to claim 2 wherein said first part includes said leg and said second part includes said locking device.

8. The anti-theft device according to claim 7 for securing a lap top to a support member having an upper surface, a lower surface, and a predetermined hole extending through the support member from the upper to the lower surfaces, wherein said leg extends from said securing member and is insertable through said hole from above the support member so as to extend partly below said support member, and said locking device is securable to said leg below said support member and engageable with the lower surface when so secured to prevent removal of the securing member.

9. The anti-theft device according to claim 8 for securing a lap top to a support member having an upper surface, a lower surface, and first arid second spaced apart predetermined holes extending through the support member from said upper to said lower surfaces, wherein said leg is a first leg and the device comprises a second leg parallel to said first leg, the first and second legs extending from said securing member for insertion through said first and second holes, respectively, said first and second legs being spaced apart a distance such that the legs can straddle a width of the lap top computer.

10. The anti-theft device according to claim 9 wherein said securing member includes a pair of said side restraining members, each side restraining member extending from a respective opposite end of said back restraining member, and a pair of said front restraining members, each extending from a respective one of said side restraining members.

11. The anti-theft device according to claim 10 wherein said first and second legs extend downwardly from respective said side restraining members.

12. The anti-theft device according to claim 9 comprising a further rigid securing member having an elongate intermediate member with first and second stop members located at opposite ends thereof for restraining movement of the lap top computer, said rigid securing member and further securing member having interlocking portions and being positionable generally transverse to each other when interlocked together, wherein when the lap top is in the closed position and positioned between the holes it can be secured to the upper surface of the support member with said legs and said first and second stop members restraining movement of the lap top computer parallel to the upper surface, and said rigid securing member and said intermediate member restraining upward movement of the lap top computer.

13. The anti-theft device according to claim 2 wherein said first part includes said locking device and said second part includes said leg.

14. The anti-theft device according to claim 13 wherein said securing member includes a pair of said side restraining members, each side restraining member extending from a respective opposite end of said back restraining member, and a pair of said front restraining members, each extending from a respective one of said side restraining members.

15. The anti-theft device according to claim 14 wherein said locking device is rigidly attached to one of said side restraining members.

16. The anti-theft device according to claim 13 wherein said leg comprises a plurality of ratchet teeth spaced along the length thereof, and said locking device has a pawl movable between a locked position in which the pawl engages a selected one of said ratchet teeth thereby preventing separation of said securing member and said second part, and an unlocked position in which said pawl is disengageable with said teeth such that said securing member and said second part may be slid apart.

17. The anti-theft device according to claim 13 for securing a lap top to a support member having an upper surface, a lower surface, and a predetermined hole extending through the support member from said upper to said lower surfaces, wherein said second part comprises an anchor member rigidly coupled to said leg, said leg being insertable through said hole from below the support member so as to extend partly above said support member, and said locking device being securable to said leg above said support member, said anchor member being engageable with the lower surface such that removal of the securing member from the support member is prevented when the leg and locking device are secured together.

18. The anti-theft device according to claim 17 wherein said anchor member is a plate provided with a plurality of apertures for using in securing said anchor member to one of said upper and lower surfaces and said leg extends upwardly from said plate in a normal direction when the plate is so secured and said locking device is securable to said leg above the support member to prevent said securing member from being removed from said support member.

19. The anti-theft device according to claim 1 wherein said securing member includes a pair of said side restraining members, each side restraining member extending from a respective opposite end of said back restraining member, and a pair of said front restraining members, each extending from a respective one of said side restraining members.

20. An anti-theft device for securing a lap top computer to a support member, the lap top computer having a monitor portion and a keyboard portion pivotally connected together by a hinge for movement between an open position in which the monitor portion extends at an angle from the keyboard portion, and a closed position in which the monitor portion and keyboard portion are substantially parallel to and adjacent to each other, the device comprising a rigid securing member having a back restraining member, a pair of said side restraining members extending from a respective opposite end of said back restraining member, and a pair of front restraining members extending from respective said side restraining members, said back, side and front restraining members defining an elongate opening dimensioned to slidably receive the monitor portion therethrough; and a locking assembly having a first part rigidly coupled to said securing member and a second part adapted to be anchored to the support member, one of said first and second parts comprising a leg, and the other of said first and second parts comprising a locking device telescopically engageable with and securable to said leg at a selected one of a plurality of locations along the length of said leg to bring said locking assembly into a securing position, said leg and locking device being movable apart to bring said locking assembly into a release position;

whereby, when the second part is anchored to the support member, a lap top computer is resting on the support member in an open position adjacent to the second part, and the locking assembly is moved to the securing position, the keyboard portion is confined between the securing member and the support member and the monitor portion is confined within said elongate opening to prevent removal of the lap top from said support member, and when the locking assembly is moved to the release position, the securing member is moved away from the support member a distance which allows the lap top computer to be removed from the support member.

* * * * *